US007150132B2

(12) United States Patent
Commins

(10) Patent No.: US 7,150,132 B2
(45) Date of Patent: Dec. 19, 2006

(54) CONTINUOUS HOLD-DOWN SYSTEM

(76) Inventor: Alfred D. Commins, 91 Douglas Rd., Friday Harbor, WA (US) 98250

( * ) Notice: Subject to any disclaimer, the term of this patent is extended or adjusted under 35 U.S.C. 154(b) by 337 days.

(21) Appl. No.: 10/639,304

(22) Filed: Aug. 12, 2003

(65) Prior Publication Data

US 2005/0055897 A1 Mar. 17, 2005

(51) Int. Cl.
*E02D 27/00* (2006.01)

(52) U.S. Cl. ..... 52/293.3; 52/295; 52/712; 52/481.1; 411/536

(58) Field of Classification Search ..... 52/293.3, 52/295, 712, 745.09, 293.1, 481.1; 411/536; 403/312

See application file for complete search history.

(56) References Cited

U.S. PATENT DOCUMENTS 3,402,952 A * 9/1968 Nissen et al. ..... 403/107
4,812,096 A * 3/1989 Peterson ..... 411/231
4,875,314 A 10/1989 Boilen
5,168,681 A 12/1992 Ayrapetyan
5,180,268 A * 1/1993 Richardson ..... 411/536
5,375,384 A 12/1994 Wolfson
5,384,993 A * 1/1995 Phillips ..... 52/92.2
5,522,688 A * 6/1996 Reh ..... 411/536
5,531,054 A 7/1996 Ramirez
5,535,561 A * 7/1996 Schuyler ..... 52/293.3
5,540,530 A 7/1996 Fazekas
5,815,999 A 10/1998 Williams
5,839,321 A * 11/1998 Siemons ..... 74/441
5,992,126 A 11/1999 Ashton et al.
6,006,487 A 12/1999 Leek
6,014,843 A * 1/2000 Crumley et al. ..... 52/167.3
6,161,339 A 12/2000 Cornett, Sr. et al.
6,161,350 A 12/2000 Espinosa
6,192,637 B1 2/2001 Boilen et al.
6,327,831 B1 12/2001 Leek
6,374,551 B1 4/2002 Boilen et al.
6,389,767 B1 5/2002 Lucey et al.
6,390,747 B1 5/2002 Commins
6,494,654 B1 12/2002 Espinosa
6,625,945 B1 9/2003 Commins
6,688,058 B1 * 2/2004 Espinosa ..... 52/293.3
6,715,258 B1 * 4/2004 Mueller ..... 52/745.12

(Continued)

FOREIGN PATENT DOCUMENTS

CA 1325874 1/1994

OTHER PUBLICATIONS

Anchor Tiedown System Multi-Story Holdown Applications, Simpson Strong-Tie, 24 pages, Mar. 2002.

(Continued)

*Primary Examiner*—Naoko Slack
*Assistant Examiner*—Chi Q. Nguyen
(74) *Attorney, Agent, or Firm*—Pate Pierce & Baird

(57) ABSTRACT

A hold-down system used to secure a building structure to the foundation, thereby enabling the building to better withstand forces like high winds and earthquakes because these forces may then be distributed to the foundation. The hold-down system is characterized as being continuous and having stackable, individual take-up units. A continuous hold-down system allows the system to compensate for shrinkage or crushing of the building's frame throughout each level of the building because the anchor of the system is always in communication with the foundation of the building. The individual take-up units are stackable allowing each level of the system to compensate for shrinkage or crushing on that level as well as adjacent levels.

18 Claims, 13 Drawing Sheets

U.S. PATENT DOCUMENTS

| | | | | |
|---|---|---|---|---|
| 2002/0108325 | A1 | 8/2002 | Hulls et al. | |
| 2003/0009964 | A1* | 1/2003 | Trarup et al. | 52/295 |
| 2003/0230032 | A1* | 12/2003 | Shahnazarian et al. | 52/167.3 |
| 2004/0105727 | A1* | 6/2004 | Jones | 405/231 |

OTHER PUBLICATIONS

Zone Four Innovative Engineered Solutions, Zone Four, 24 pages, 2000.

* cited by examiner

CONTINUOUS HOLD-DOWN SYSTEM

BACKGROUND

1. Field of the Invention

The present invention relates to building construction, and more specifically, to apparatus for anchoring shear walls to foundations and lower floors.

2. Background

Strong winds and earthquakes subject walls and others elements of a building to tremendous forces. If these forces are not distributed to the proper elements or structures capable of withstanding such force, the building may be torn apart. Foundations are often the strongest element of a building. Securely tying the walls of a building to the foundation greatly improves structural performance during periods of strong wind or earthquake. Securement promotes single body motion and limits whiplash amplification that often results in structural failure.

Under extreme conditions, a building may be violently loaded or shaken back and forth in a lateral (side to side) direction. If a shear wall is tightly restrained at its base, loads may be smoothly transferred to the foundation. The loads may then be resolved in the foundation, where they appear as tension and compression forces.

Buildings are often composed of long walls, (walls with a length greater than the height) and short walls (walls that have a length shorter than the height). The tendency for a wall to lift vertically off a foundation is inversely proportional to the length of the wall. Tall narrow shear walls, which may be found in nearly all homes, act as lever arms and may magnify an imposed load. In certain instances, the actual load on the securement system may be magnified to several times the originally imposed load.

The as-built building is generally not the building that will be sustaining loads induced by wind or by earthquake shaking. Wood components of the building structure, including floors, joists, sill plates, top plates, and studs, will shrink. Shrinkage varies greatly but ranges typically from about one-quarter inch under the best of conditions, to well over one inch depending on the total cross-grain stack up (depth) of wood.

Wall securement may prevent lateral and vertical motion between the walls and the foundation. Additionally, it may be necessary to support the wall against forces that would tend to distort the wall's general rectangular shape. Building codes often require external and load bearing walls to be shear resistant by providing a plywood plane to support shear forces that may be imposed on the wall. Many times, building codes also require lateral and vertical securement of a wall to the foundation. Lateral and vertical securement may be accomplished by employing hold-downs, also referred to as tie-downs.

Hold-down systems are employed to secure walls of upper levels to walls of lower levels, as well as walls to foundations. Again the principle is to secure the entire structure to the foundation where structural forces can best be resolved. However, lower levels can present amplification of structural weaknesses to upper levels. If a hold-down system installed on a given level cannot compensate for all shrinkage and crushing affecting that level, structural weaknesses may be amplified on adjacent levels. Hold-down systems need to be able to compensate for structural weaknesses throughout the structure, and not just within a given level.

Moreover, hold-down systems can be difficult to install and expensive to fabricate. Some hold-down systems require assembly within narrow tolerances, making assembly difficult and time consuming. Other hold-down systems cannot compensate for structural weaknesses throughout the structure, causing an overload of a hold-down system on a given level. Accordingly, a need exists for a hold-down system that may be easily installed and utilizes the full potential of the system over the entire structure. It would be a further advancement to provide a hold-down system that may be produced and installed in greater quantities with greater speed and less expense.

BRIEF SUMMARY AND OBJECTS OF THE INVENTION

It is an object of the present invention to provide a continuous hold-down system that may be easily and quickly installed.

It is a further object of the present invention to provide a hold-down system that may be mass produced inexpensively.

In certain embodiments, the apparatus and method in accordance with the present invention may include a foundation with an anchor, which anchor is composed of threaded rods coupled together and extending through one or more levels of a building or structure. The anchor provides a basis for the individual components of the continuous hold-down system. The take-up units used in the system help maintain tension throughout the system, essentially securing the entire structure to the foundation. Securing the structure to the foundation enables the structure to better withstand various forces acting on the structure. These forces are transferred to the foundation where they can be dissipated more efficiently.

While previous hold-down systems may be considered useful for similar purposes, the continuous hold-down system described herein is a more effective and efficient system. Previous hold-down systems may not be continuous, thereby isolating each individual level of the building. The continuous nature of the current invention allows the system to compensate for shrinkage or crushing which may occur on any level of the building. Thus, if shrinkage or crushing on one level exceeds the capacity of the system on that level, the system on other levels can compensate for the excess.

Another feature of this particular continuous hold-down system is that the individual take-up units used in the system are stackable, more than one take-up unit may be stacked providing greater ability to compensate for shrinkage and crushing. This is especially helpful in the continuous system because the system is capable of compensating for shrinkage and crushing which may occur on any level of the building. Therefore, if the top level of the building has a couple of take-up units stacked on top of each other, those units can compensate for any excess shrinkage or crushing throughout the building. This can also be especially helpful on upper levels of a building because shrinkage and crushing that may occur on lower levels tend to be accentuated on upper levels.

A continuous hold-down system as described herein can also be used for the specific purpose of supporting a portal frame. The system can be installed on either side of a portal frame, thereby making the portal frame self-cinching. A shear wall is generally a frame that is further supported by attaching a shear plane (e.g. a sheet of wood) over the frame. The added support helps maintain the original, intended shape of the wall. However, a portal frames an opening lacking such shear support. It does not allow the supporting sheet to be attached, thereby losing that support. The portal becomes more susceptible to shearing forces and a change of shape. As the portal is stressed, the framing material of the portal can be damaged or crushed thereby losing tension in the support system. The take-up units in accordance with the invention automatically and continuously compensate for any crushing.

BRIEF DESCRIPTION OF THE DRAWINGS

The foregoing and other objects and features of the present invention will become more fully apparent from the following description and appended claims, taken in conjunction with the accompanying drawings. Understanding that these drawings depict only typical embodiments of the invention and are, therefore, not to be considered limiting of its scope, the invention will be described with additional specificity and detail through use of the accompanying drawings in which:

DETAILED DESCRIPTION OF THE PREFERRED EMBODIMENTS

It will be readily understood that the components of the present invention, as generally described and illustrated in the Figures herein, may be arranged and designed in a wide variety of different configurations. Thus, the following more detailed description of the embodiments of the system and method of the present invention, as represented in FIGS. 1 through 13, is not intended to limit the scope of the invention. The scope of the invention is as broad as claimed herein. The illustrations are merely representative of certain, illustrative embodiments of the invention. Those embodiments of the invention will be best understood by reference to the drawings, wherein like parts are designated by like numerals throughout.

Several Figures display an automatic take-up unit. This device is described fully in U.S. Pat. No. 6,390,747 issued May 21, 2002, to this inventor, and incorporated herein by reference.

Those of ordinary skill in the art will, of course, appreciate that various modifications to the details of the Figures may easily be made without departing from the essential characteristics of the invention. Thus, the following description of the Figures is intended only by way of example, and simply illustrates certain embodiments consistent with the invention.

Figure 1:
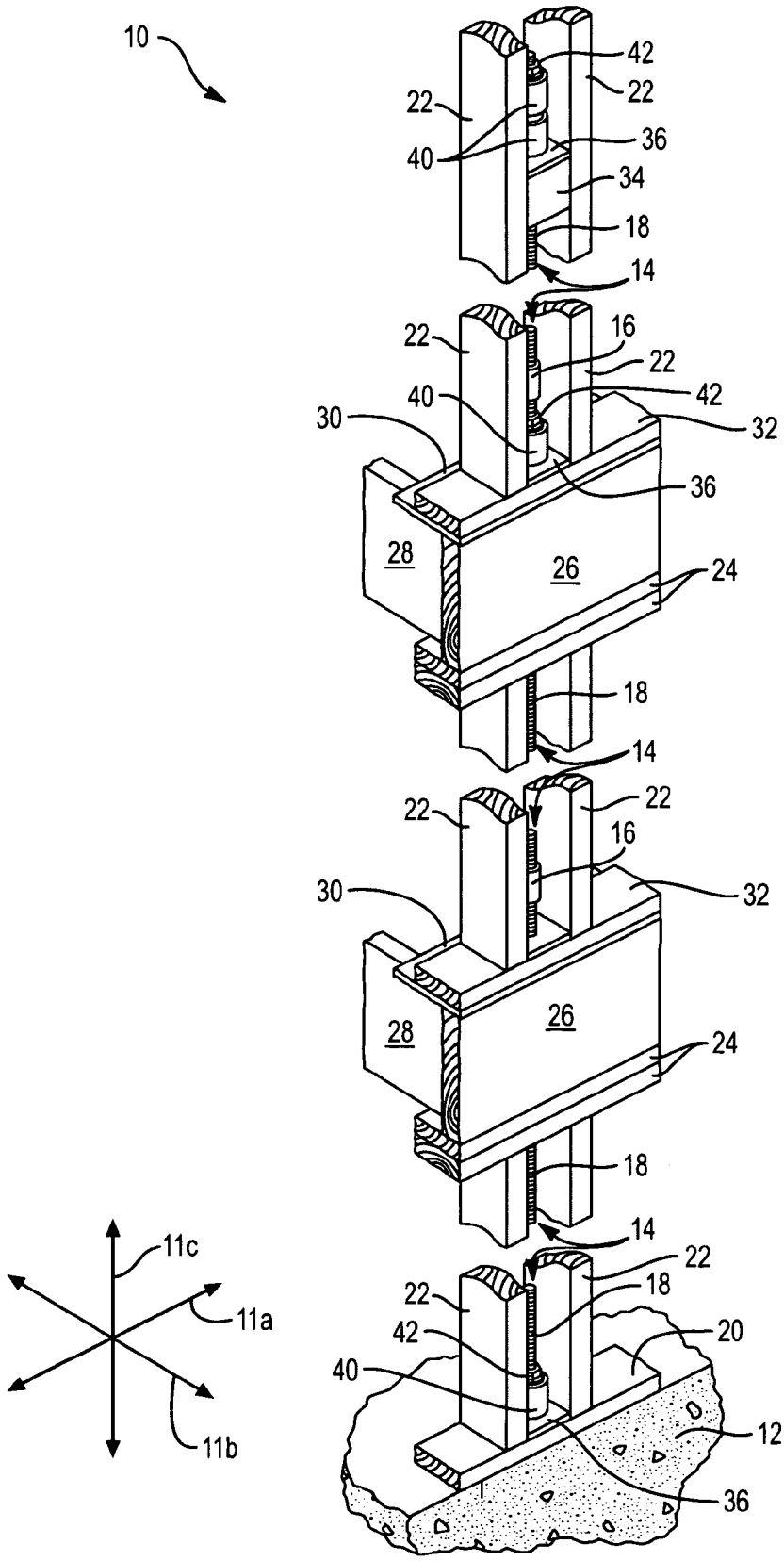
FIG. 1 is a perspective view of a continuous hold-down system.

In discussing the Figures, it may be advantageous to establish a reliable coordinate system, referring to FIG. 1, to aid in the description of several of the embodiments in accordance with the present invention. Coordinate axes 11 may be defined by a wall as longitudinal 11*a* along the wall, lateral 11*b* through or across the wall, and transverse 11*c* up and down the wall height. The longitudinal 11*a*, lateral 11*b*, and transverse directions 11*c* are substantially orthogonal to one another. In the description to follow, the embodiments will be oriented so that they are aligned and primarily configured to oppose or transfer longitudinal loads of shearing forces by precluding or resisting motion in a transverse direction 11*c*. Embodiments in accordance with the present invention are secured in a longitudinal direction to resist or transfer forces and loads along more than one axis simultaneously. Several embodiments, however, may be particularly well suited to resisting or transferring loads in a given direction, and as previously mentioned, this principal axis for shear loading will typically be substantially the transverse axis 11*c*.

A continuous hold-down system 10 in accordance with the present invention may include a foundation 12 wit an anchor 14 extending transversely 11*c* from the foundation 12, the anchor 14 also extending transversely 11*c* through a surface to be retained and engaging a take-up unit 40 secured in place along the anchor 14 by a retainer 42. The anchor 14 may be composed of a single threaded rod 18 or multiple threaded rods 18 secured together with a coupler 16.

The foundation 12 may be any structural foundation 12 that may be used in construction, having a lateral thickness and extending longitudinally 11*a*. Typical materials for the foundation 12 include concrete, steel, stone, and wood. The anchor 14 generally begins as a threaded rod 18 embedded in a concrete foundation 12 (often welded to reinforcing bar) and extending transversely 11*c* out from the foundation 12. The anchor 14 may be composed of numerous threaded rods 18. A coupler 16 may be attached to the distal end (away from the foundation 12) of one threaded rod 18 and the proximal end (toward the foundation 12) of another threaded rod 18, thereby extending the anchor 14 transversely 11*c*.

Figure 2B:
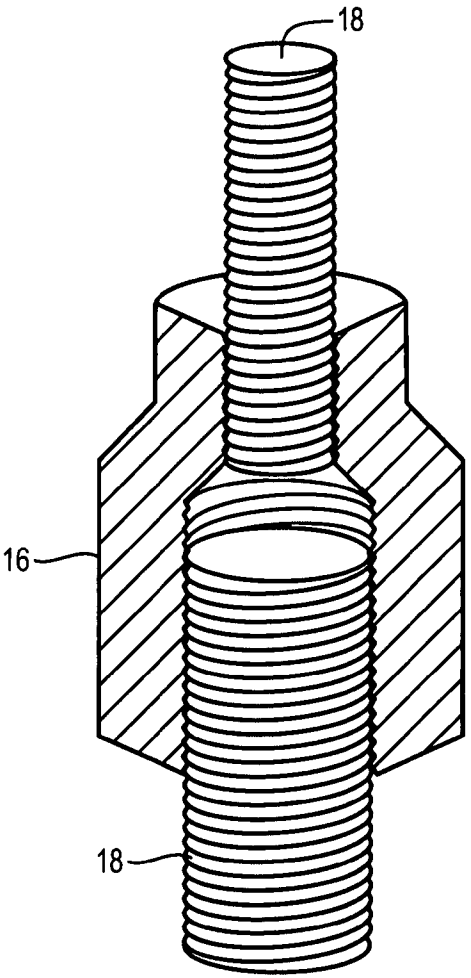
FIG. 2 is a partially cut-away, perspective view of a coupler connecting two threaded rods of the same diameter (2A) and a coupler connecting two threaded rods of different diameters (2B)
Figure 2A:
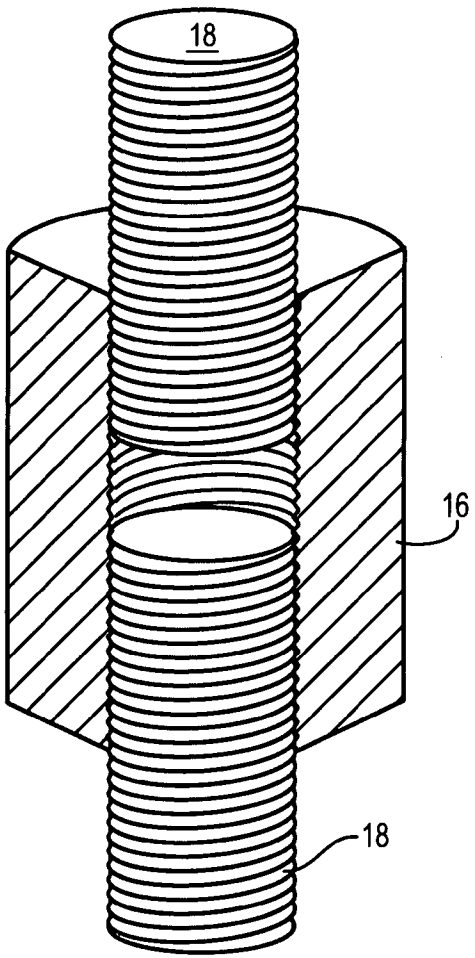

Using this method, the anchor 14 is extended through successive levels of the structure and provides for transferring to the foundation 12 forces applied to the structure 70, or shear wall 70. Typical materials for the threaded rod 18 include steel, other metals, reinforced composites, and plastic. Typical threaded rods 18 may be continuously threaded along the length of the rod 18, or be threaded only on the end portions of the rod 18 leaving the center portion smooth. Typical materials for the coupler 16 include steel and plastic, and will generally match the material used for the threaded rod 18. The coupler 16 can join threaded rods 18 of the same diameter (as shown in FIG. 2A), or the coupler 16 can join threaded rods 18 of varying diameters (as shown in FIG. 2B).

A sill plate 20 is a member proximate the foundation 12 and extending parallel or longitudinally 11*a* with the foundation 12. The sill plate 20 provides a base for vertical framing members 22, which extend transversely 11*c*. The vertical framing members 22 have a proximate end (toward the foundation 12) and a distal end opposite. A top plate 24 is attached to the vertical framing members 22 at the distal end of the framing members 22 and extends longitudinally 11*a*. A shear wall 70 may be formed by attaching a sheet or sheets of plywood or other structural material to the sill plate 20, vertical framing members 22 (e.g. studs 22), and top plate 24. Numerous top plates 24 may be used. However, a top plate 24 may support a header 26, extending longitudinally 11*a*, and one or more trusses 28, extending laterally 11*b*. The header 26 and the beams 28 or trusses 28 (e.g. joists 28, beams 28, etc.) may support flooring 30. This configuration generally describes an initial level of a structure.

A base plate 36 is a member proximate the flooring 30 and extending longitudinally 11*a*. The base plate 36 serves a function similar to the sill plate 20 by providing a base for vertical framing members 22 extending transversely 11*c*. The vertical framing members 22 have a proximate end (toward the foundation 12) and a distal end opposite. A top plate 24 is attached to the vertical framing members 22 at the distal end of the framing members 22 and extends longitudinally 11*a*. A shear wall 70 may be formed by attaching a sheet or sheets of plywood or other structural material to the base plate 36, vertical framing members 22, and top plate 24. Numerous top plates 24 may be used. However, a top plate 24 may support a header 26, extending longitudinally 11*a*, and one or more trusses 28, extending laterally 11*b*. The header 26 and the trusses 28 may support flooring 30. This configuration generally describes a subsequent level of a structure. Obviously, subsequent levels may be added to other subsequent levels creating a multi-level structure.

The sill plate 20, the vertical framing member 22, the top plate 24, the base plate 32, the header 26, and the trusses 28 make up the framing components and may be any structural support member used in construction. They may have a variety of cross-sectional configurations, such as rectangular, circular, I-beam, or any other suitable design. Typical materials include wood and metal. However, embodiments in accordance with the present invention may be applied to any material having the desired structural characteristics.

The anchor 14 extends transversely 11*c* through the sill plate 20 of an initial level. The sill plate 20 may be secured to the foundation 12 using a take-up unit 40. The take-up unit 40 may be placed around the anchor and rest upon the sill plate 20, or rest upon a bearing plate 36. The bearing plate 36 may be in the form of a plate or washer and is typically steel, but may be made of any suitable material. The take-up unit 40 is axially independent of the anchor 14, thereby facilitating quick and easy installation of the take-up unit 40. The take-up unit 40 is secured in place along the anchor 14 between the surface to be retained, sill plate 20 or bearing plate 36, and a retainer 42 proximate the take-up unit 40. The retainer 42 threadedly engages the anchor 14 to keep the take-up unit 40 in contact with the sill plate 20 or bearing plate 36. The take-up unit 40 extends transversely 11*c* to maintain contact between the sill plate 20 and the foundation 12.

The anchor 14 may be extended using a coupler 16 and a threaded rod 18. The coupler 16 may be threadedly attached to the anchor 14, and then threadedly attach the threaded rod 18 to the coupler 16. This method can be used to extend the anchor 14 through the sill plate 20 and top plate 24 of the initial level of a structure. The use of a take-up unit 40 on the initial level as previously described is optional, depending on the design of the building and the intention of the builder. A take-up unit 40 on every level has been shown effective.

The anchor 14 extends transversely 11*c* through the base plate 32 of a subsequent level. The base plate 32 may be secured to the structure using a take-up unit 40. The take-up unit 40 may be placed around the anchor and rest upon the base plate 32, or rest upon a bearing plate 36 which bearing plate 36 may be in the form of a plate or washer and is typically steel, but may be any suitable material. The take-up unit 40 is axially independent of the anchor 14, thereby sliding along the anchor and facilitating quick and easy installation of the take-up unit 40. The take-up unit 40 is secured in place along the anchor 14 between the surface to be retained, base plate 32 or bearing plate 36, and a retainer 42 proximate the take-up unit 40. The retainer 42, such as a nut 42, threadedly engages the anchor 14 to keep the take-up unit 40 in contact with the base plate 32 or bearing plate 36. The take-up unit 40 extends transversely 11*c* to maintain contact between the base plate 20 and the structure.

The anchor 14 may be extended using a coupler 16 and a threaded rod 18. The coupler 16 may be threadedly attached to the anchor 14, and then the threaded rod 18 may be threadedly attached to the coupler 16. This method can be used to extend the anchor 14 through the base plate 32 and top plate 24 of a subsequent level of a structure. The use of a take-up unit 40 on a subsequent level as previously described is optional depending on the design of the building and the intention of the builder. Obviously, this method can be used to secure any subsequent level to the structure, thereby making it possible to transfer to the foundation 12 forces applied to the structure. However, the rods 18 nearest the foundation 12 should be sized to support the additive loads of subsequent levels thereabove.

Figure 3:
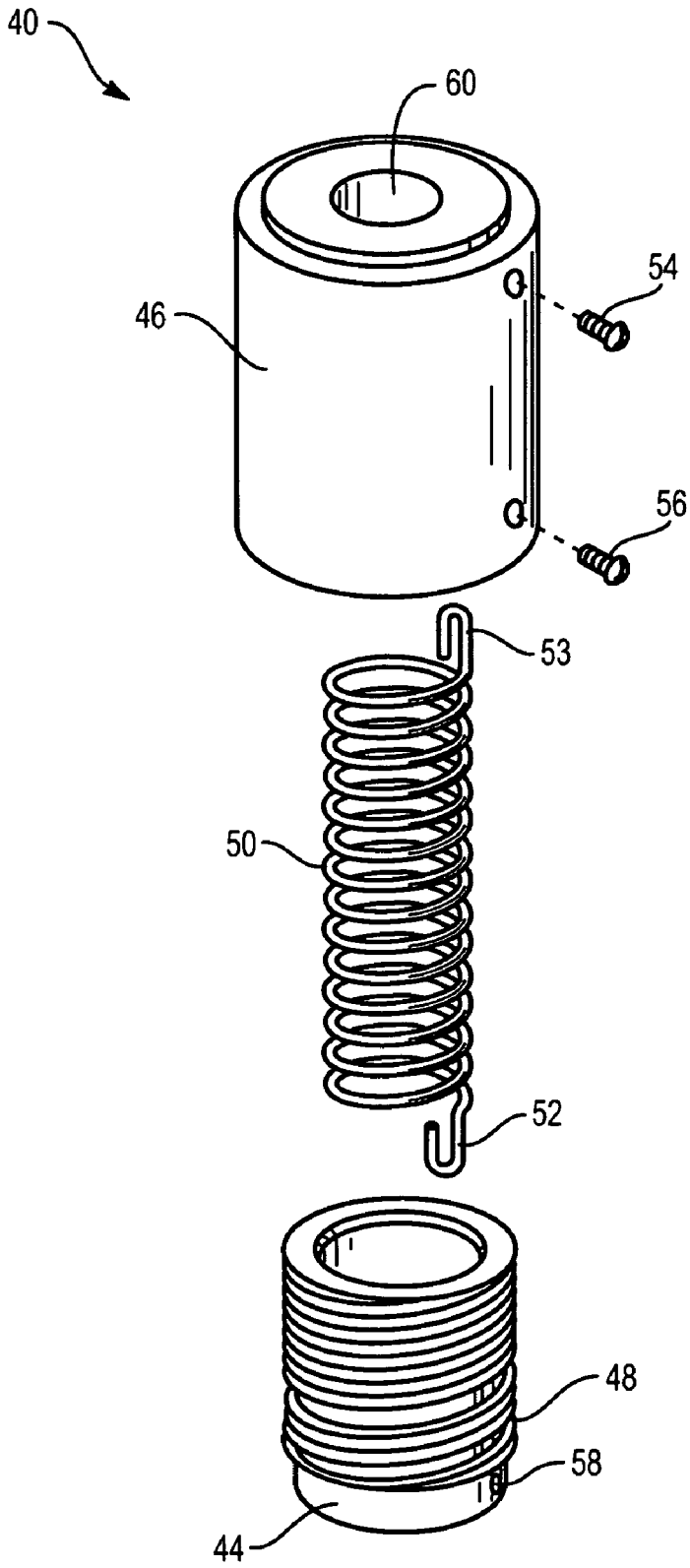
FIG. 3 is an exploded view of an automatic take-up unit.

FIG. 3 depicts the individual components of a take-up unit 40. The three major components of the take-up unit 40 are the base 44, the slide 46, and the bias element 50, which bias element 50 is typically a spring. The base 44 and slide 46 are engaged using the threads 48. The bias element 50 provides a self-energizing force to urge rotation of the slide 46 relative the base 44 in a direction to effect an increase in height of the take-up unit 40, the increase in height occurring transversely 11*c*. The bias element 50 may be attached to the base 44 using a tab 52. The bias element 50 may be pre-loaded before the tab 53 is attached to the slide 46 using a tab fastener 54. The base 44 and slide 46 may be rotated relative to each other until the trigger 56 may be engaged within the socket 58. Once the trigger 56 is engaged, the take-up unit 40 is ready for installation. The anchor 14 extends through the aperture 60, and the trigger 56 is removed to activate the take-up unit 40. A more detailed description of the take-up unit is available in U.S. Pat. No. 6,390,747.

The components of the continuous hold-down system 10 used on any given level of the structure may vary. FIG. 1 illustrates a variety of configurations. In one embodiment the initial level may have a take-up unit 40 resting on a bearing plate 36 securing the sill plate 20 to the foundation 12. In one embodiment, the anchor 14 maybe extended through any subsequent level of a structure without using a take-up unit 40 to secure the base plate 32 to the structure. In one embodiment, a take-up unit 40 may rest on a bearing plate 36 securing a base plate 32, wit the anchor 14 extended by a coupler 16 and a threaded rod 18. In one embodiment, two take-up units 40 are stacked transversely 11*c* on the final level of the structure to compensate for shrinkage or crushing that may exceed the capacity of take-up units 40 on preceding levels.

FIG. 1 also shows how a take-up unit 40 may be installed transversely 11*c* along an anchor 14 between levels of a structure. A blocking board 34 may be installed between vertical framing members 22, thereby providing a surface to be restrained and a position where a take-up unit 40 may be installed.

Figure 4:
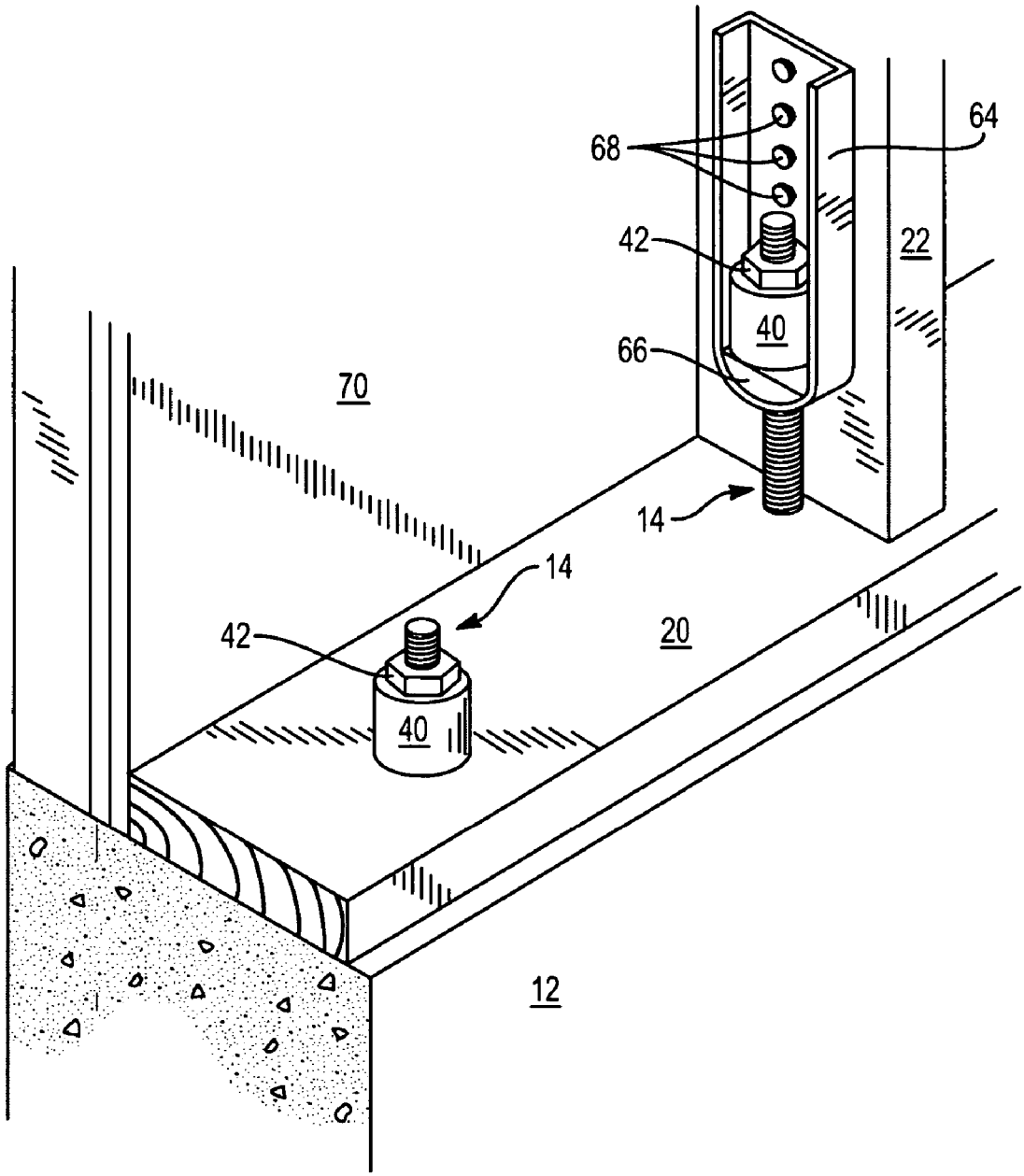
FIG. 4 is a perspective view of varied uses of the automatic take-up units securing a sill plate to a foundation, including allowing the take-up unit to rest directly upon the sill plate, or using a bracket to support the take-up unit.

FIG. 4 illustrates how a take-up unit 40 may rest directly on the sill plate 20 when securing the sill plate 20 to the foundation 12. FIG. 4 also illustrates how a bracket 64 may be used to provide a bearing surface 66 to support a take-up unit 40 on an initial level. The bracket 64 is secured to a vertical framing member 22 using bracket fasteners 68. The take-up unit 40 urges the transverse 11*c* movement of the vertical framing member 22 toward the foundation 12.

Figure 5:
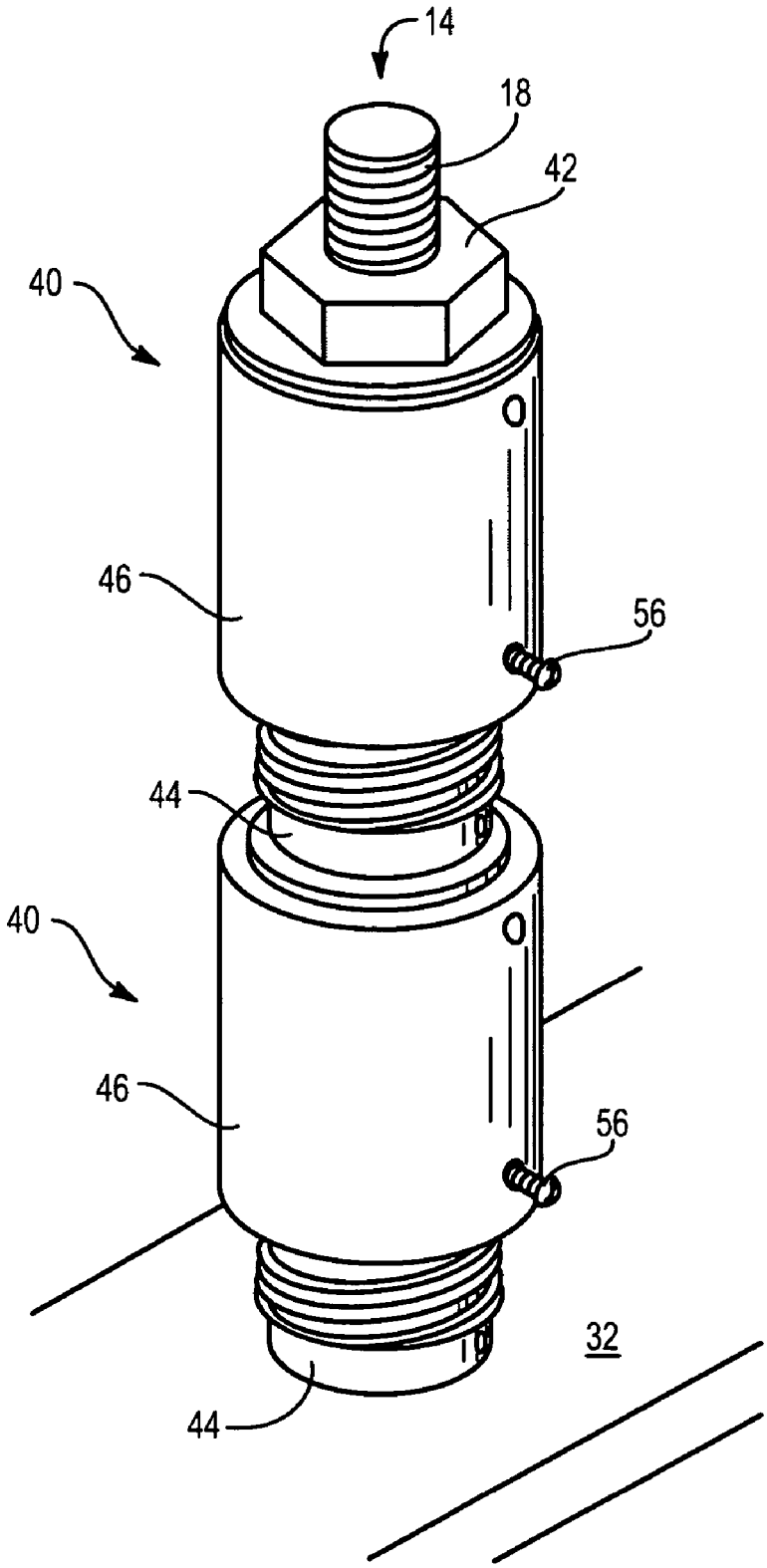
FIG. 5 is a perspective view of two automatic take-up units stacked on top of each other.
Figure 6:
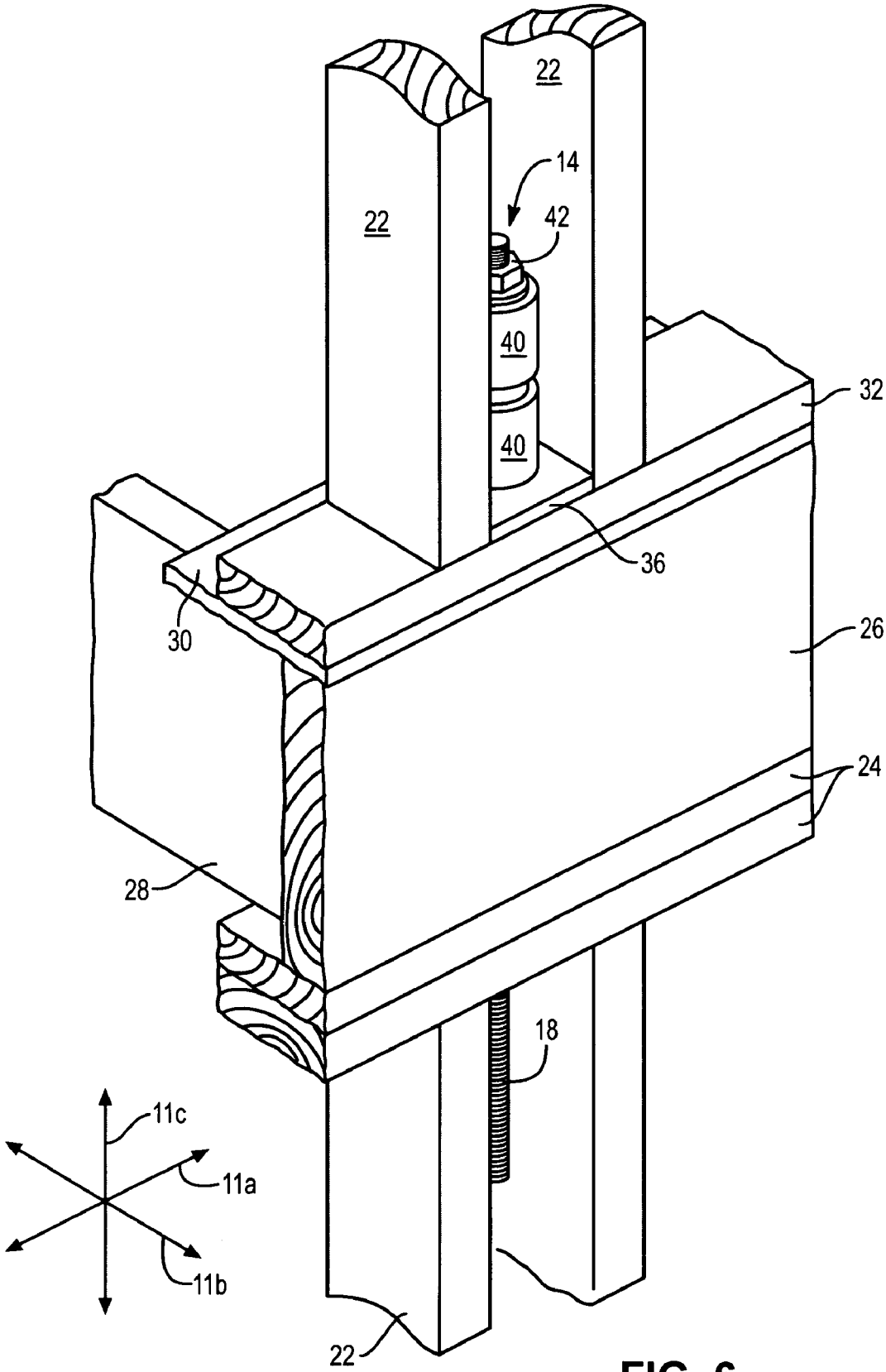
FIG. 6 is a perspective view of one embodiment of a hold-down system.

As shown in FIG. 5, two take-up units 40 may be stacked transversely 11*c* on the initial level of a structure. As shown in FIG. 6, two take-up units 40 may be stacked transversely 11*c* on a subsequent level of a structure. Stacking two take-up units 40 on any level increases the capacity to compensate for shrinkage or crushing on that level as well as other levels throughout the system. It may also be advantageous to stack two take-up units 40 on the upper levels of a structure because problems with shrinkage and crushing created on lower levels can be accentuated on upper levels. Also, the continuous nature of the system 10 allows compensation for shrinkage and crushing to occur on any level, thereby compensating for any level where the associated take-up unit 40 may have fully extended.

Figure 7:
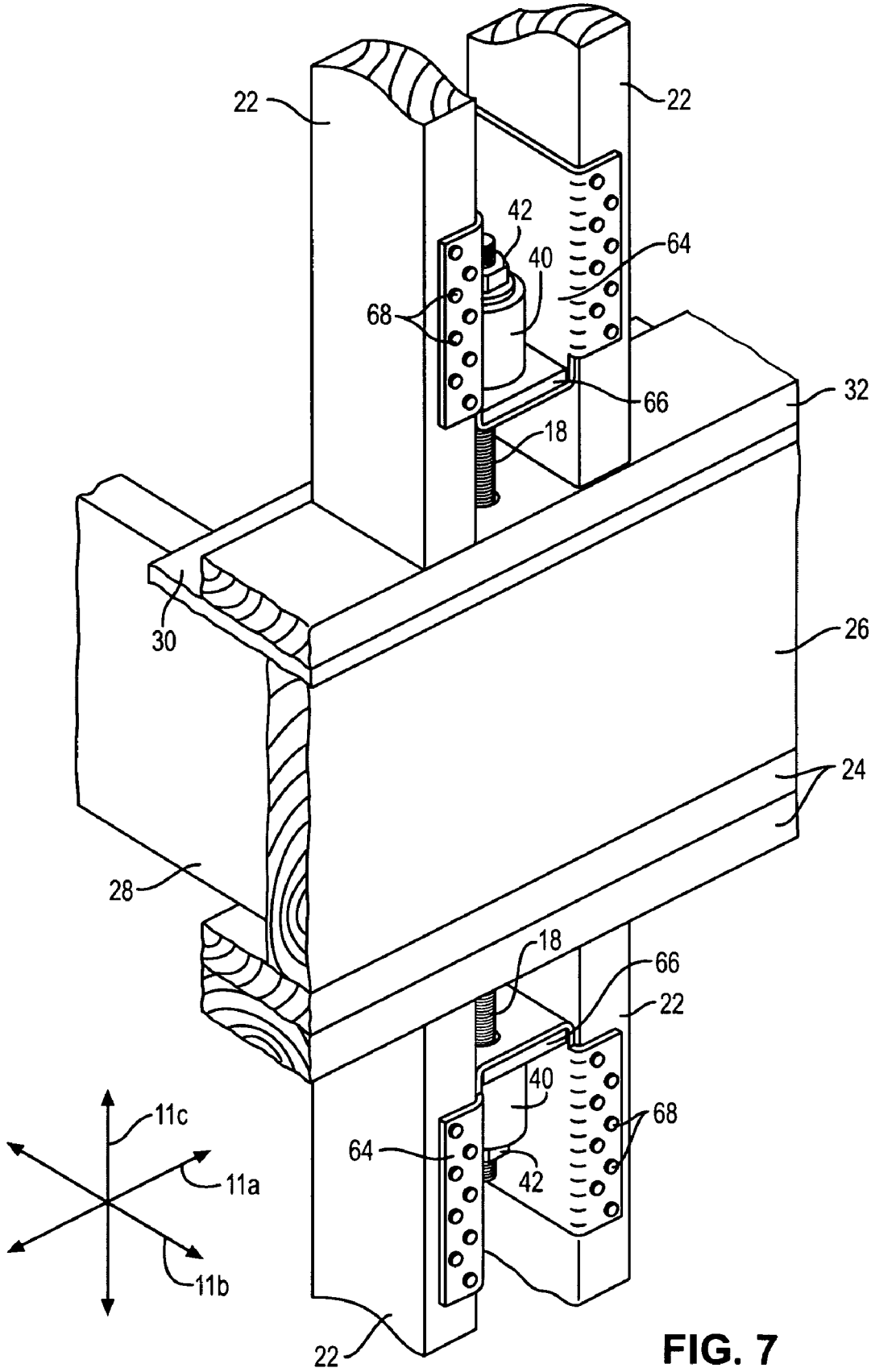
FIG. 7 is a perspective view of another embodiment of a hold-down system.

As shown in FIG. 7, a bracket 64 may be installed between vertical framing members 22, thereby providing a position where a take-up 40 may be installed. The bracket 64 may be attached to the vertical framing members 22 using bracket fasteners 68. The bracket 64 provides a bearing surface 66 upon which a take-up unit 40 may be installed. FIG. 7 also shows the use of brackets 64 and take-up units 40 on opposing sides of a transition to a subsequent level of a structure. This configuration would help secure one level of the structure to the adjacent level. Installation of a take-up unit 40 proximate the bearing surface 62 urges the vertical framing members 22, to which the bracket 64 has been attached, in a transverse 11*c* direction away from the retainer 42. The retainer 42 secures the take-up unit 40 to the anchor 14.

Figure 8:
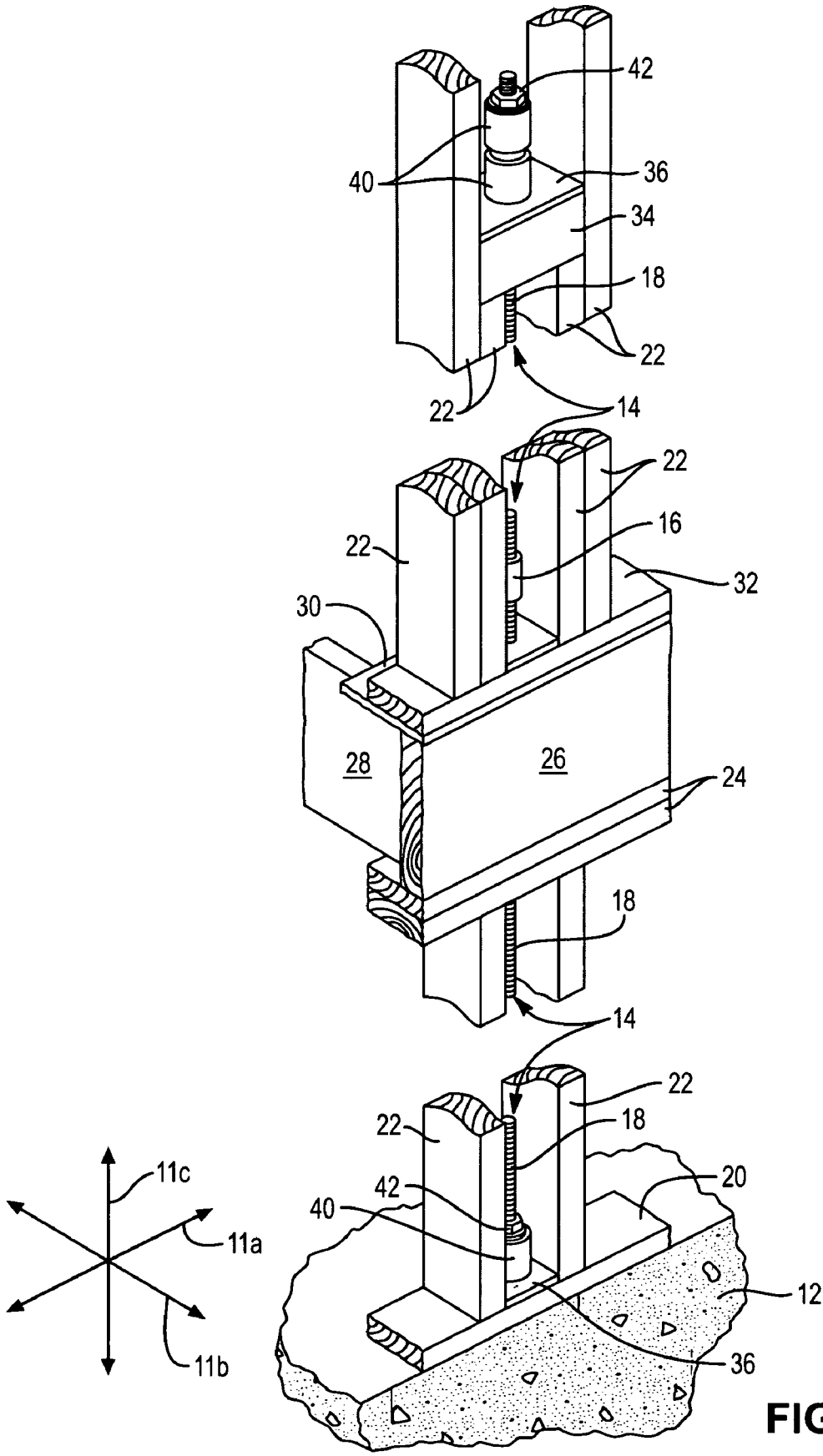
FIG. 8 is a perspective view of another embodiment of a hold-down system.

In one embodiment, as illustrated particularly in FIG. 8, a blocking board 34 is further supported by vertical framing members 22. The blacking board 34 provides a surface to be restrained between levels of a building. One or more vertical framing members 22 may be used, like pillars, underneath and on either side of the blocking board 34 in order to support the blocking board 34. The vertical framing members 22 providing support underneath the blacking board 34 keep the blocking board 34 from being pulled transversely 11*c* as tension is applied to the continuous hold-down system 10. While one take-up units 40 may be installed to restrain the blocking board 34, two take-up units 40 may be also be used to increase the capacity of the continuous hold-down system 10.

The anchor 14 may be extended through the initial level of the structure without using a take-up unit 40 to secure the sill plate 20 to the foundation 12. This configuration is generally used near portals 72, and is illustrated in FIGS. 9, 10, 12 and 13.

One use of the continuous, threaded hold-down system 10 is providing support for portal frames. As described earlier, a shear wall 70 is composed of a frame and a sheet of supporting material such as plywood attached to the frame providing extra support. A shear wall 70 is designed to help the wall support shearing loads in a longitudinal direction and maintain its shape. If a force is applied longitudinally 11*a* to a shear wall 70, the structure of the shear wall 70 will resist this force, without distorting or lifting, and the shape and position of the shear wall 70 will be maintained.

Portal frames are basically shear walls 70 that have a portal 72. The portal 72 is typically a door or a window, but may be any portal 72 that does not allow the use of a continuous sheeting material to complete the shear wall 70. The portal 72 will diminish the resistance to shearing forces, or longitudinal 11*a* forces. The use of a continuous hold-down system 10 provides extra support to shear wails 70 that have a portal 72.

Figure 9:
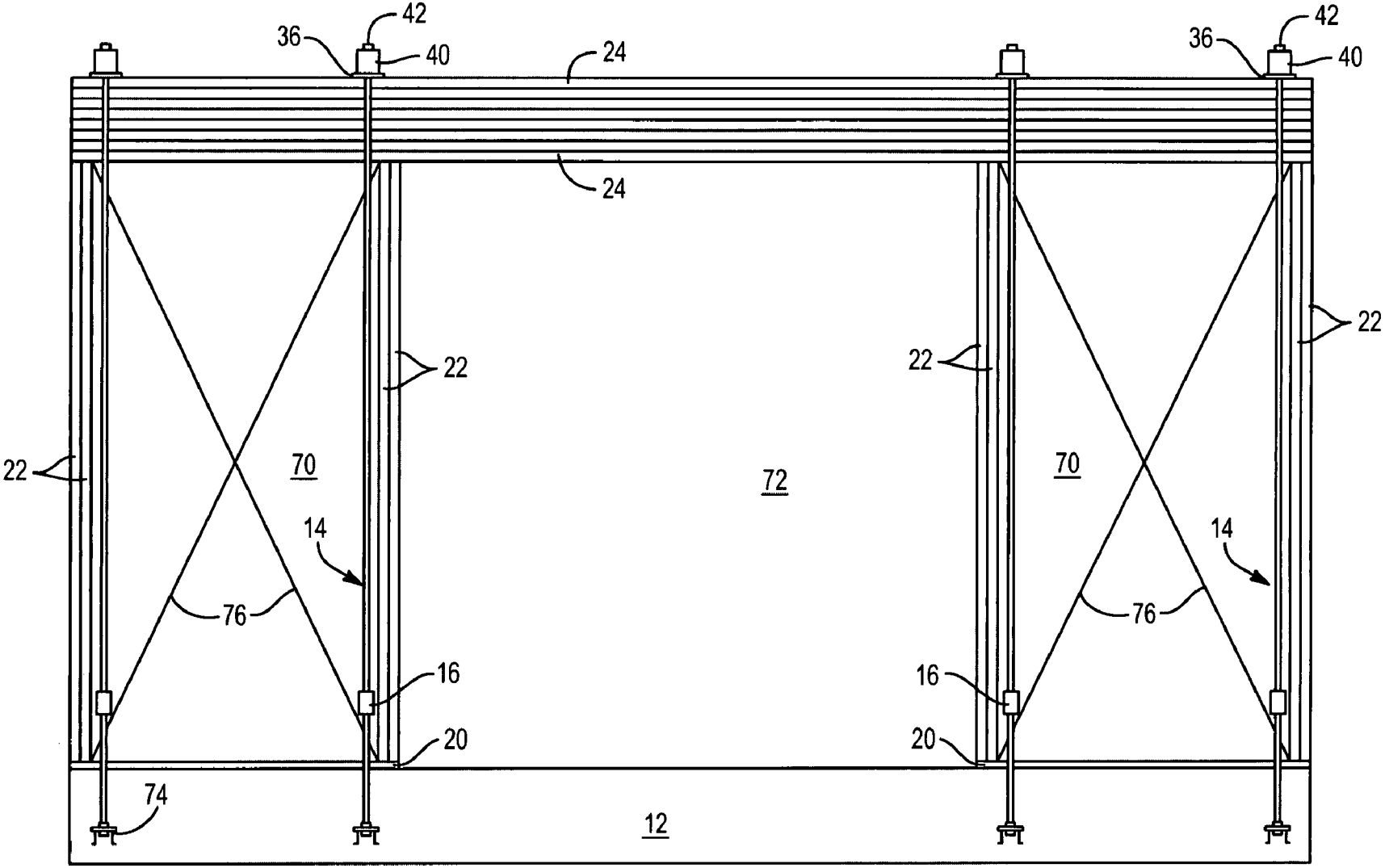
FIG. 9 is an elevation cross-sectional view of a self-cinching portal frame.
Figure 10:
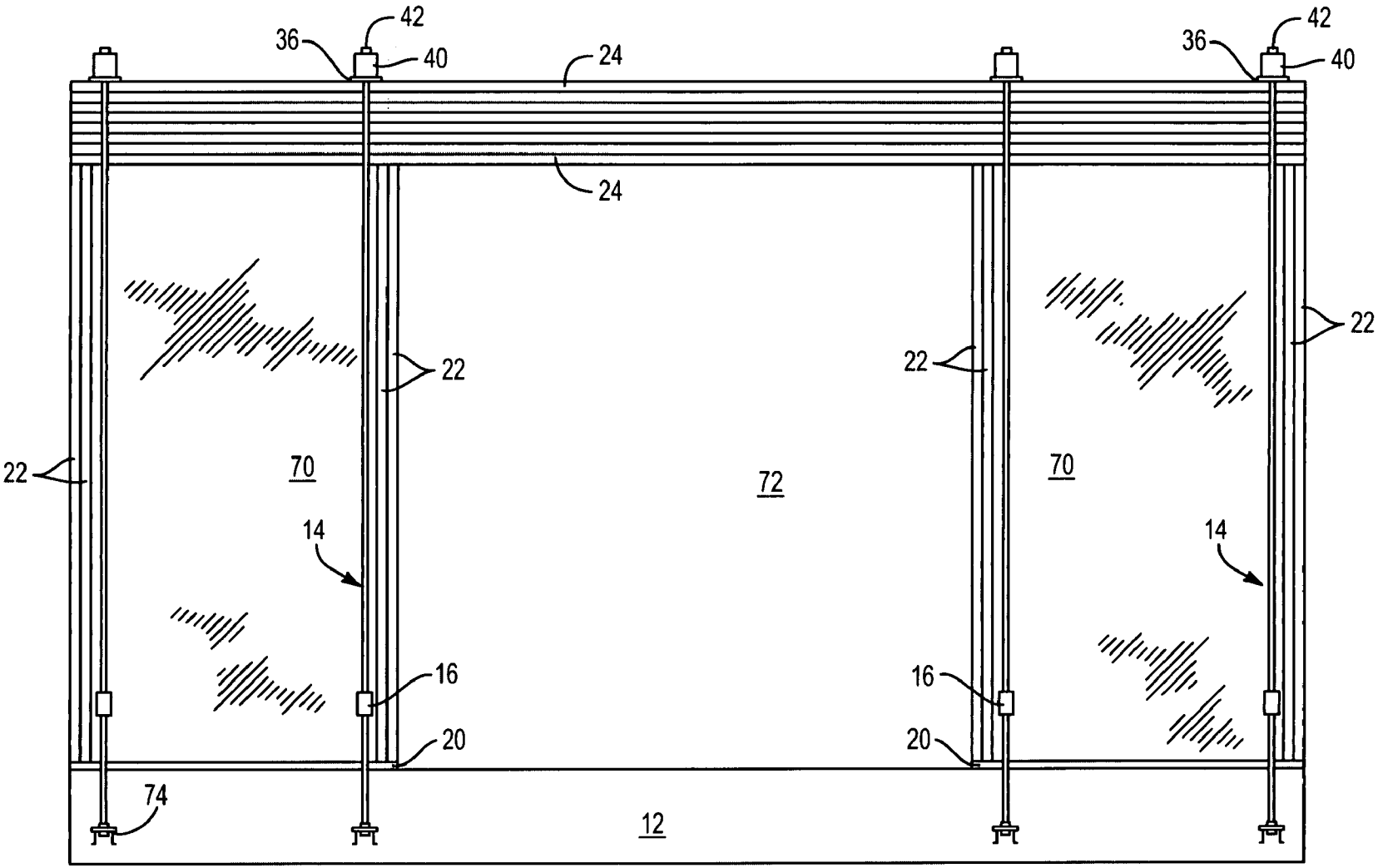
FIG. 10 is an elevation cross-sectional view of a self-cinching portal frame.

As shown in FIG. 9, the continuous hold-down system 10 may be assembled on either side of a doorway 72 or portal 72. The anchor 14 may have a foundation assembly 74 embedded in the foundation 12. The anchor 14 extends transversely 11*c* from the foundation 12. A coupler 16 may be threadedly attached to the anchor 14 and a threaded rod 18 may be threadedly attached to the coupler 16, thereby extending the anchor 14 transversely 11*c* above the level of the top plate(s) 24. A take-up unit 40 may be installed and rest on the top plate 24, or a bearing plate 36. A retainer 42 is then threadedly attached to the anchor 14 securing the take-up unit 40 in place. This method may be repeated for either side of the portal 72.

In one embodiment, cables 76 are attached to the sill plate 20 and the top plate 24 on either side of the portal 72. The cables 76 travel from the sill plate 20 to the top plate 24 longitudinally 11*a* and transversely 11*c*, thus providing triangulated support to the portal 72 through tensile loading of the cables 76. Attaching the cables 76 in this manner gives the cables 76 the appearance on an "X" circumscribed by the vertical framing members 22, the sill plate 20, and the top plate 24. Again, cables 76 can be used in this manner on either side of a portal 72. In another embodiment, shown in FIG. 10, a shear wall 70 on either side (or both) of the portal 72 provides shear support to the portal 72.

Figure 11:
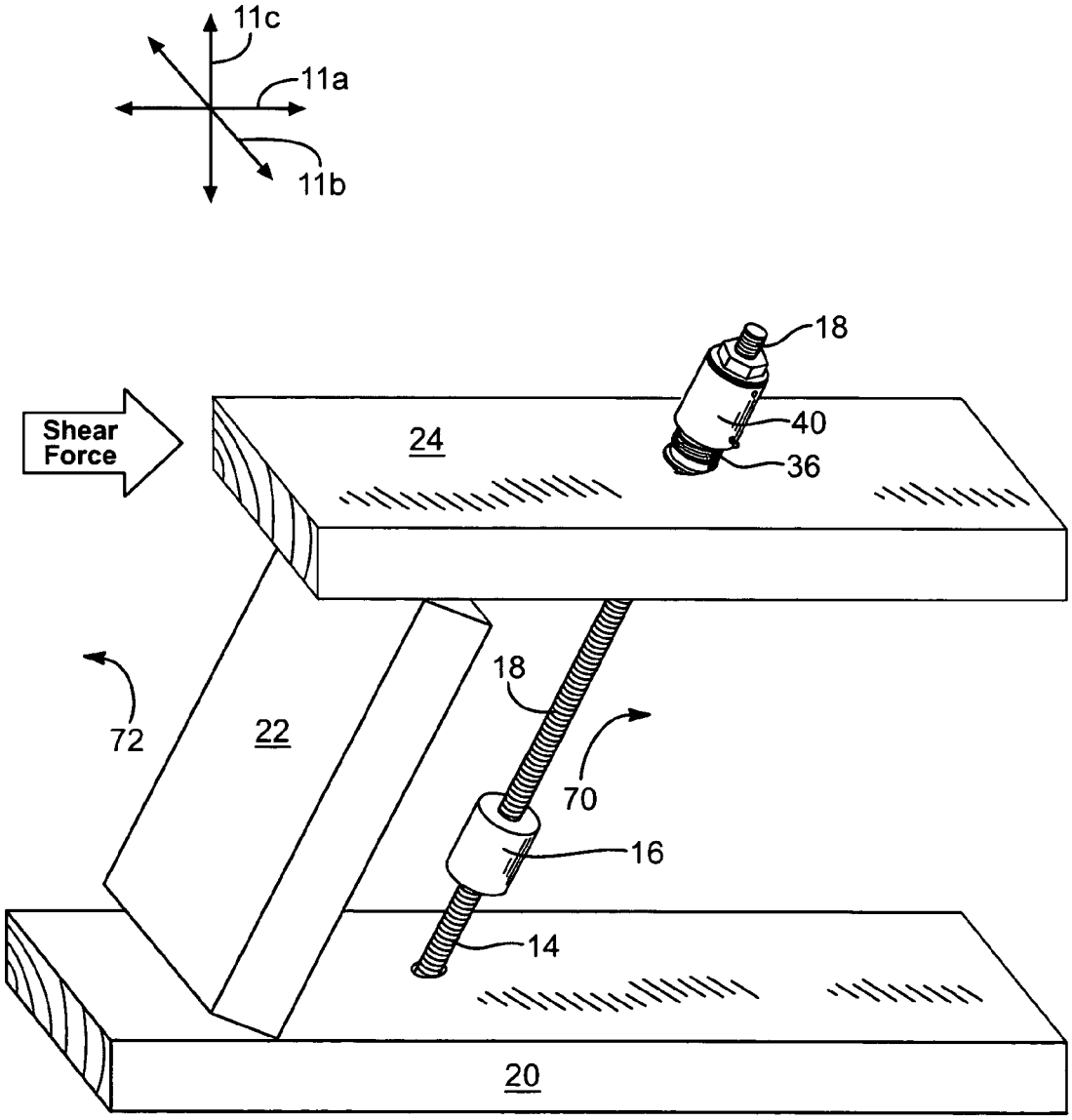
FIG. 11 is a perspective view of shearing force acting on a continuous hold-down system illustrating how crushing may occur.

The use of the continuous, threaded hold-down system 10 in this manner results in a self-cinching portal frame. As shown in FIG. 11, a shearing force, or longitudinal 11*a* force, may distort the shape of a portal 72 and adjacent shear walls 70. As the portal 72 is distorted in shape, the continuous, threaded hold-down system 10 may begin to angle in the direction of the longitudinal 11*a* force, thereby causing crushing of the top plate 24 at the point where the take-up unit 40 or bearing plate 36 contacts the top plate 24. The angle of distortion is somewhat exaggerated in FIG. 11 to better illustrate the crushing of the top plate 24 caused by the longitudinal 11*a* force.

As the longitudinal 11*a* force abates and the portal 72 returns to its original position, the decreased dimension due to crushing may result in a loss of tension in the continuous, threaded hold-down system 10. However, the take-up unit 40 expands to compensate for any crushing and maintains the desired tension in the continuous hold-down system 10. It is apparent that the continuous hold-down system 10 as described would compensate for substantially any loss of tension resulting from shrinkage or from crushing caused by any longitudinal 11*a* force applied to the portal 72.

Figure 12:
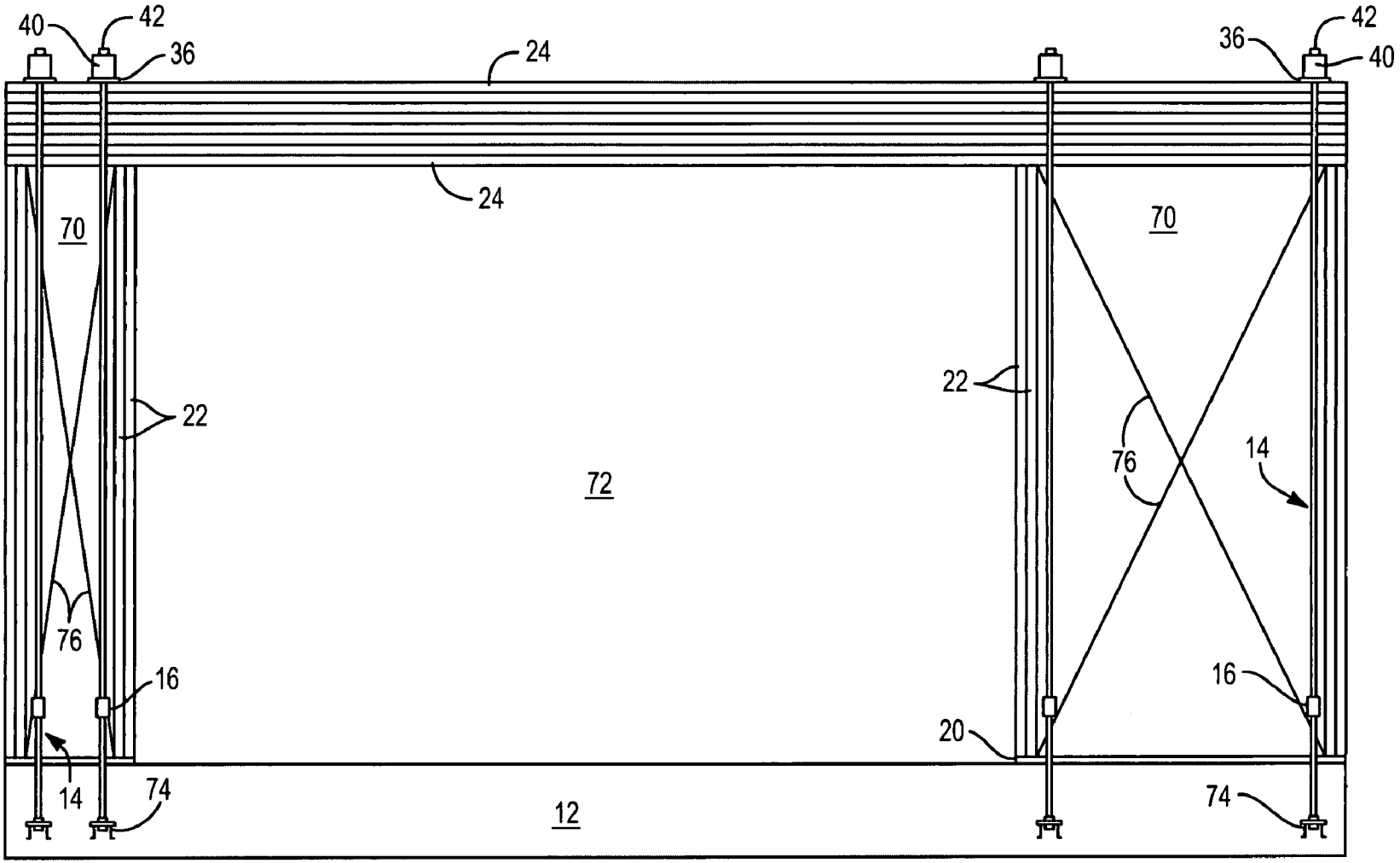
FIG. 12 is an elevation cross-sectional view of one embodiment of a self-cinching portal frame.
Figure 13:
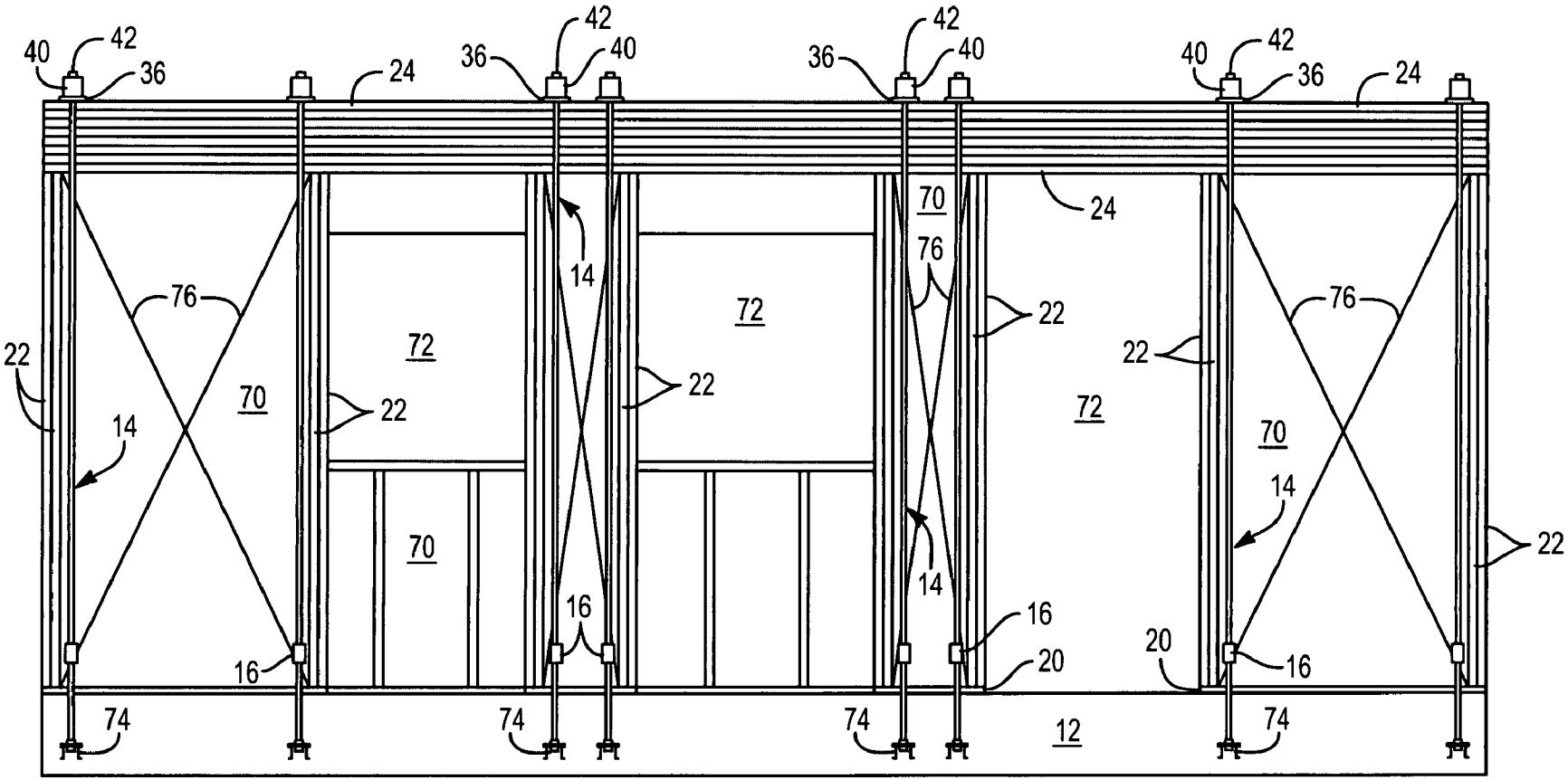
FIG. 13 is an elevation cross-sectional view of one embodiment of a self-cinching portal frame.

The continuous hold-down system 10 may be used on portals 72 varying in size and purpose. FIG. 12 illustrates the use of the continuous hold-down system 10 to produce a self-cinching garage door portal 72. FIG. 13 illustrates the use of the continuous hold-down system 10 in a wall containing window portals 72 and doorway portals 72.

From the above discussion, it will be appreciated that the present invention provides novel apparatus and methods directed to a hold-down for securing first and second support members to an anchoring device. The hold-down may have a first and a second flange, each flange having multiple securement apertures to facilitate securement to the first and second support members respectively. A base may connect the first and second flange and have an aperture for admitting and securing the anchoring device. When loaded in application, the first and second flanges may be configured to be loaded in tension.

The present invention may be embodied in other specific forms without departing from its spirit or essential characteristics. The described embodiments are to be considered in all respects only as illustrative, and not restrictive. The scope of the invention is, therefore, indicated by the appended claims, rather than by the foregoing description. All changes that come within the meaning and range of equivalency of the claims are to be embraced within their scope.

What is claimed and desired to be secured by United States Letters Patent is:

1. An assembly comprising:

a foundation;

a shear wall supported above the foundation, the shear wall comprising an upper portion and a top plate extending horizontally across the upper portion thereof, the shear wall defining a portal extending therethrough, the portal having a first side and a second side spaced apart from one another;

a first anchor positioned proximate the first side of the portal and extending from the foundation through the top plate;

a second anchor positioned proximate the second side of the portal and extending from the foundation through the top plate;

a first retainer engaging the first anchor at a first distance above the top plate;

a second retainer engaging the second anchor at a second distance above the top plate;

a first take-up device positioned and expandable to fill the first distance; and a second take-up device positioned and expandable to fill the second distance; wherein the shear wall further comprises at least one cable providing triangulated support therefor.

2. The assembly of claim 1, wherein the portal defines an opening in the shear wall.

3. The assembly of claim 2, wherein the opening corresponds to one of a doorway, garage door, and window.

4. The assembly of claim 3, wherein the foundation comprises a concrete structure.

5. The assembly of claim 4, wherein the shear wall corresponds to one of a first story and another story above the first story.

6. The assembly of claim 4, further comprising a first bearing plate positioned between the first take-up device and the top plate, and a second bearing plate positioned between the second take-up device and the top plate.

7. The assembly of claim 4, wherein the first take-up device comprises a base, a slide, the base and slide mutually threaded to provide relative linear translation during multiple revolutions of relative rotation of the slide wit respect to the base, the base and slide being formed to have a clearance hole to receive the first anchor therethrough, and a bias element urging the relative rotation in a direction selected to provide axial expansion.

8. The assembly of claim 7, wherein the first anchor comprises at least one threaded rod.

9. The assembly of claim 8, wherein the first anchor further comprises a coupler and an anchor bolt extending from within the foundation, the coupler connecting the anchor bolt to a threaded rod of the at least one threaded rod.

10. The assembly of claim 1, wherein the foundation comprises a concrete structure forming the lower portion of a building.

11. The assembly of claim 1, wherein the shear wall corresponds to one of a first story and another story above the first story.

12. The assembly of claim 1, further comprising a first bearing plate positioned between the first take-up device and the top plate, and a second bearing plate positioned between the second take-up device and the top plate.

13. The assembly of claim 1, wherein the shear wall further comprises at least one cable providing triangulated support therefor.

14. The assembly of claim 1, wherein the first take-up device comprises a base, a slide, the base and slide mutually threaded to provide relative linear translation during multiple revolutions of relative rotation of the slide with respect to the base, the base and slide being formed to have a clearance hole to receive the first anchor therethrough, and a bias element urging the relative rotation in a direction selected to provide axial expansion.

15. The assembly of claim 1, wherein the first anchor comprises at least one threaded rod.

16. The assembly of claim 1, wherein the first anchor further comprises a coupler, an anchor bolt extending form within the foundation, and at least one threaded rod, the coupler connecting the anchor bolt to a threaded rod of the at least one threaded rod.

17. An assembly defining longitudinal, lateral, and transverse directions substantially orthogonal to one another, the assembly comprising:

a foundation;

a shear wall supported in the transverse direction above the foundation, the shear wall comprising a first support member extending in the transverse direction from a lower end to an upper end, a second support member spaced in the longitudinal direction from the first support member and extending in the transverse direction from a lower end to an upper end, and a top plate extending in the longitudinal direction across the upper ends of the first and second support members, the shear wall defining a portal extending in the transverse direction therethrough at a location between the first and second support members;

a first anchor positioned proximate the first support member and extending in the transverse direction from the foundation through the top plate;

a second anchor positioned proximate the second support member and extending in the transverse direction from the foundation through the top plate a first retainer engaging the first anchor a first distance above the top plate in the transverse direction;

a second retainer engaging the second anchor a second distance above the top plate in the transverse direction;

a first take-up device positioned and expandable to fill the first distance; and a second take-up device positioned and expandable to fill the second distance; wherein the shear wall further comprises at least one cable providing triangulated support therefor.

18. The assembly of claim 17, wherein the shear wall further comprises shear paneling extending in the transverse and longitudinal directions and supported by at least one of the first and second support members.

* * * * *